US005314510A

United States Patent [19]

Hammer et al.

[11] Patent Number: 5,314,510

[45] Date of Patent: May 24, 1994

[54] METHOD FOR PREVENTING THE GROWTH OF AEROBIC FUNGI IN AQUEOUS HYDROCARBONS

[75] Inventors: Leif Hammer, Solroed Strand; Benny Smith, Nyborg, both of Denmark

[73] Assignee: BP Chemicals (Additives) Limited, London, United Kingdom

[21] Appl. No.: 15,036

[22] Filed: Feb. 8, 1993

Related U.S. Application Data

[63] Continuation of Ser. No. 768,456, Sep. 30, 1991, abandoned, which is a continuation of Ser. No. 483,993, Feb. 22, 1990, abandoned, which is a continuation of Ser. No. 363,083, Jun. 8, 1989, abandoned.

[30] Foreign Application Priority Data

Jun. 29, 1988 [GB] United Kingdom ..... 8815424

[51] Int. Cl.[5] ..... C10L 1/22; C10L 1/30

[52] U.S. Cl. ..... 44/317; 44/314; 44/331

[58] Field of Search ..... 44/331, 317, 314

[56] References Cited

U.S. PATENT DOCUMENTS

| | | | |
|---|---|---|---|
| 3,203,971 | 8/1965 | De Gray et al. | 260/462 |
| 3,325,262 | 6/1967 | De Gray et al. | 44/72 |
| 3,347,646 | 10/1967 | De Gray et al. | 44/76 |
| 3,443,918 | 5/1969 | Kautsky et al. | 44/63 |
| 3,564,091 | 2/1971 | Degray et al. | 44/76 |
| 3,723,460 | 3/1973 | Brannen et al. | 44/63 |
| 3,873,279 | 3/1975 | Singer | 44/76 |
| 3,877,890 | 4/1975 | Maisey et al. | 44/76 |
| 3,991,056 | 11/1976 | Okamoto et al. | 260/268 C |
| 4,092,127 | 5/1978 | Ryer et al. | 44/63 |
| 4,097,389 | 6/1978 | Andress, Jr. | 44/63 |
| 4,426,305 | 1/1984 | Malec | 252/49.6 |
| 4,440,656 | 4/1984 | Horodysky | 252/49.6 |
| 4,718,919 | 1/1988 | DeLue et al. | 44/76 |
| 4,728,340 | 3/1988 | Vos | 44/62 |
| 4,765,800 | 8/1988 | Van Es et al. | 44/62 |
| 4,855,074 | 8/1989 | Papay et al. | 44/63 |

FOREIGN PATENT DOCUMENTS

| | | |
|---|---|---|
| 773169 | 4/1957 | United Kingdom . |
| 994496 | 6/1965 | United Kingdom . |

*Primary Examiner*—Jacqueline V. Howard
*Attorney, Agent, or Firm*—Nixon & Vanderhye

[57] ABSTRACT

Aerobic fungal growth in hydrocarbons contaminated with water is prevented by addition thereto of an additive comprising boron and a hydrocarbyl-substituted succinimide in which the hydrocarbyl substituent is of a size sufficient to impart hydrocarbon solubility.

11 Claims, 4 Drawing Sheets

METHOD FOR PREVENTING THE GROWTH OF AEROBIC FUNGI IN AQUEOUS HYDROCARBONS

This is a continuation of application Ser. No. 07/768,456, filed Sep. 30, 1991, now abandoned, which is a continuation of application Ser. No. 07/483,993, filed Feb. 22, 1990, now abandoned, which is a continuation of application Ser. No. 07/363,083, filed Jun. 8, 1989, now abandoned.

The prevent invention relates to a method for preventing the growth of aerobic fungi in aqueous hydrocarbons, for example middle distillate fuels, by addition thereto of a material having biostatic activity and to aqueous hydrocarbon compositions containing such material having biostatic activity.

BACKGROUND OF THE INVENTION

In the presence of water and oxygen, at least some of the hydrocarbons comprised in, for example, middle distillate fuels are readily attacked by aerobic fungi, typically the omnipresent *Cladosporium resinae*. These fungi may cause the following problems:

DESCRIPTION OF THE INVENTION (i) Form a tightly woven mat of mycelium at the oil/-water interface leading to build-up of mixed fungal and bacterial biomass at the interface. Release of these mats tends to clog filters.

(ii) This mixed population produces soluble organic compounds which are often efficient emulsifiers. Fuel/water separation is thereby impaired. Acid metabolites and biopolymers are also produced.

(iii) The dead biomass accumulating at the tank bottom allows the growth of anaerobic sulphate reducing bacteria.

With reference to (iii) above, after the aerobic fungi have initiated events leading to formation of a suitable anoxic environment for anaerobes the sulphate reducing bacteria can start to develop. The bacteria obtain the energy required for their metabolism by reducing sulphate ions to sulphide, e.g. $H_2S$, and in so-doing impart a bad odour to the fuel, but worse than that, they are implicated in fast progressive pitting corrosion of metals with which they are in contact, for example fuel tanks.

The problems arising from the presence of aerobic fungi in fuels for example are by now well-recognised in practical terms. Thus, in domestic and industrial heating systems clogging growths in storage tanks can produce acid by-products or SRB activity that attack metal surfaces and if unchecked this corrosion can eat its way through tank walls, ultimately necessitating tank replacement. Moreover, the growth of slimes can foul tank floats, prevent flow in fuel lines, foul filters and hinder combustion of fuel oil. Corrosion of the legs of drilling rigs, in which diesel fuel is sometimes stored, is also a recognised problem.

Since the fungi, which initiate the problem, thrive only at or near oil/water interfaces, it would clearly be prudent to avoid all possibility of stale water accumulating in the fuel system, but this is not always practicable. With the increase in the severity of cracking the content of aromatics in all fuels is increasing, leading to increases in water solvency and in susceptibility to emulsion formation. Whilst a number of additives intended in use to clean up the system are known, all are not entirely satisfactory. There is a need for a simple additive material which (i) cannot be deactivated by any enzyme system which the microbes may develop, (ii) does not pollute the drain water, i.e. it must be added to and stay in the fuel and it must have a low animal toxicity, (iii) is effective at sufficiently low treatment levels to be used in a package added at a total of a few hundred ppm., and (iv) need not necessarily have biocidal (killing) effect, biostatic (preventing growth) effect should be sufficient.

We have now found that compositions comprising a hydrocarbyl-substituted succinimide in which the hydrocarbyl substituent is of sufficient size to impart hydrocarbon solubility and boron provides at least some of the aforesaid needs.

The use of an oil-soluble borated acylated nitrogen compound in combination with gasoline fuel is known. Thus, U.S. Pat. No. 4,092,127 discloses a fuel to which has been added, in an amount sufficient to provide from about 80 to 400 parts per million by weight of boron of an anti-dieseling combination of:

(a) 1 part by weight of an oil-soluble acyl nitrogen compound characterised by the presence within its structure of a substantially saturated hydrocarbon-substituted polar group selected from the class consisting of acyl, acylimidoyl and acyloxy radicals wherein the substantially saturated hydrocarbon substituent contains at least about 16 to 180 aliphatic carbon atoms and a nitrogen-containing group characterised by a nitrogen atom attached directly to said polar material, and (b) from about 2 to about 40 parts by weight of a solvent oil having oxidation stability and a viscosity ranging from 8 to 20 cs at 99° C.

U.S. Pat. No. 4,184,851 discloses a fuel composition which comprises a major proportion, i.e. more than 50% by weight, of a distillate petroleum fraction preferably having an atmospheric boiling range of from about 120° C. to about 400° C. and from about 0.001 to 1.0 wt % of borated oil-soluble succinamic acid or its derivative having the following formula:

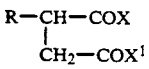

wherein R is a straight chain aliphatic hydrocarbon group having from 0 to 1 site of olefinic unsaturation (alkyl or alkenyl) attached at a secondary carbon atom to the succinyl group and is of at least 8 carbon atoms, generally in the range of 14 to 40 carbon atoms and more usually in the range of 15 to 30 carbon atoms; one of X and $X^1$ is hydroxyl and the other is $$-NYY^1$$

wherein N has its normal meaning of nitrogen and Y and $Y^1$ are aliphatic hydrocarbyl groups of from 8 to 40 carbon atoms, more usually of from 14 to 30 carbon atoms, having a total of from about 30 to 52 carbon atoms, more usually of from 32 to 48 carbon atoms, optimally of from 32 to 40 carbon atoms, preferably said one of X and $X^1$ is of the formula:

$$OH(NHY^2Y^3)_n$$

wherein n varies from 0 to 1, $Y^2$ and $Y^3$ are the class of hydrogen, an aliphatic hydrocarbon of from 1 to 30 carbon atoms and oxyaliphatic hydrocarbon of from 3 to 30 carbon atoms, and $Y^2$ and $Y^3$ may be taken together with the nitrogen to which they are attached to form a heterocyclic ring of from 5 to 7 annular members.

Neither U.S. Pat. Nos. 4,092,127 nor 4,184,851 addresses the problem of fungal growth in hydrocarbon fuels contaminated with water.

According to the present invention there is provided a process for the prevention of aerobic fungal growth in hydrocarbons contaminated with water by addition thereto of an additive characterised in that the additive comprises boron and a hydrocarbyl-substituted succinimide in which the hydrocarbyl substituent is of a size sufficient to impart hydrocarbon solubility.

In another aspect the present invention provides a fuel composition comprising a hydrocarbon contaminated with water and a fungal growth inhibiting amount of an additive characterised in that the additive comprises boron and a hydrocarbyl-substituted succinimide in which the hydrocarbyl substituent is of a size sufficient to impart hydrocarbon solubility.

Hydrocarbyl-substituted succinimides are well known as dispersant additives in lubricating oils, see for example GB-A-922,831; GB-A-1565627 and EP-A-0031236 as representative of the extensive patent literature on this subject. Both mono- and bis-succinimides may be employed. The hydrocarbyl substituent may suitably be a substantially saturated hydrocarbyl group containing from about 20 to about 300 carbon atoms, preferably from about 40 to 150 carbon atoms. The substantially saturated hydrocarbyl group is preferably derived from a polyolefin, more preferably from a polyisobutene.

The boron may be present in the additive either in the form of a physical admixture with or chemically bound to the hydrocarbyl-substituted succinimide.

In the form of a physical admixture, boron may suitably be present as a boron compound, preferably in the form of a particulate dispersion thereof, suitably incorporating also a carrier for the boron compound. Suitably the boron compound may be present as boric acid or a boron salt. The boron compound is preferably in the form of the ammonium salt of boric acid. Suitably the carrier may be a hydrocarbon-compatible high-boiling material. Suitable carrier materials include mineral oils which may be solvent refined or otherwise, synthetic lubricating oils, for example of the ester type, liquid polyolefins, for example low molecular weight polyisobutenes, or their oxidised or aminated derivatives, amino and hydroxy derivatives of polyolefins, or liquid olefin copolymers. The carrier may also comprise the hydrocarbyl succinimide component. The mean particle size of the particulate dispersion may suitably be less than 1 micron, preferably less than 0.5 micron.

A suitable dispersion of the boron compound may be prepared by wholly or partially desolvating a solvent-in-carrier emulsion of a solution of the boron compound in the presence or absence of the hydrocarbyl-substituted succinimide, preferably in its presence. Suitable solvents for the boron compound include hydrocarbons and substituted hydrocarbons of relatively low boiling point and water, water being preferred.

The preparation of a particulate dispersion of the boron compound is more fully described in our copending European application No. 88303638.6 (BP Case No. 6651/6756).

Thus, as described in that application at page 4 thereof, an inorganic phase prepared by reacting an alkali metal hydroxide with boric acid in water at 40° C. was added to an organic phase comprising a dispersant (a pentaerythritol pibsate ester) in a carrier (Example 1-SN100 base oil; Example 2-White Oil) in a homogenizer (a single stage laboratory homogenizer) over a period of 1 hour at 300–400 bar. The reactants were circulated through the homogenizer at 500–700 bar for a further 4 hours whereupon much of the water evaporated. The product, a clear liquid, was drained from the homogenizer and used without further processing.

There is an extensive patent literature describing boronated succinimides and their preparation. Representative of the patents literature may be mentioned U.S. Pat. Nos. 3,344,069; 3,322,670; 3,338,832; 3,282,955; 3,254,025 and 3,087,936. The boronated succinimides as described in any of the aforesaid patent publications may be employed. The boron content of the boronated succinimide may be in the range from about 0.1 to about 20% wt.

The hydrocarbon may be any hydrocarbon which is susceptible to fungal growth in the presence of water and oxygen. Thus, the hydrocarbon may be a crude oil or a crude oil distillate fraction. Suitable hydrocarbon fractions include gasoline, diesel fuel, heavy marine fuels and fuel oils including both domestic and industrial heating oils. Whatever, the hydrocarbon, it is contaminated with water, which may be present in amounts as low as 0.1% w/w, or less.

The amount of the additive suitably employed may conveniently be defined in terms of the amount of boron incorporated into the fuel. Suitably the amount of additive used may be sufficient to provide up to 500, more generally up to 200 ppm wt in the hydrocarbon.

The additive may suitably be compounded with other additives conventionally employed in fuel compositions, for example in the case of a diesel fuel composition the additive package may further incorporate at least one of an anti-rust agent, an anti-foam agent, an antioxidant and a demulsifier. It is an advantage of the additives of the present invention that in addition to providing biostatic activity, they also provide dispersant properties, i.e. they behave as multifunctional additives.

BRIEF DESCRIPTION OF THE DRAWINGS AND EXAMPLES

The invention will now be further illustrated with reference to the following Examples and drawings in which:

FIGS. 1–4 show plots of the growth of different fungi as a function of days of incubation.

Figure 1A:
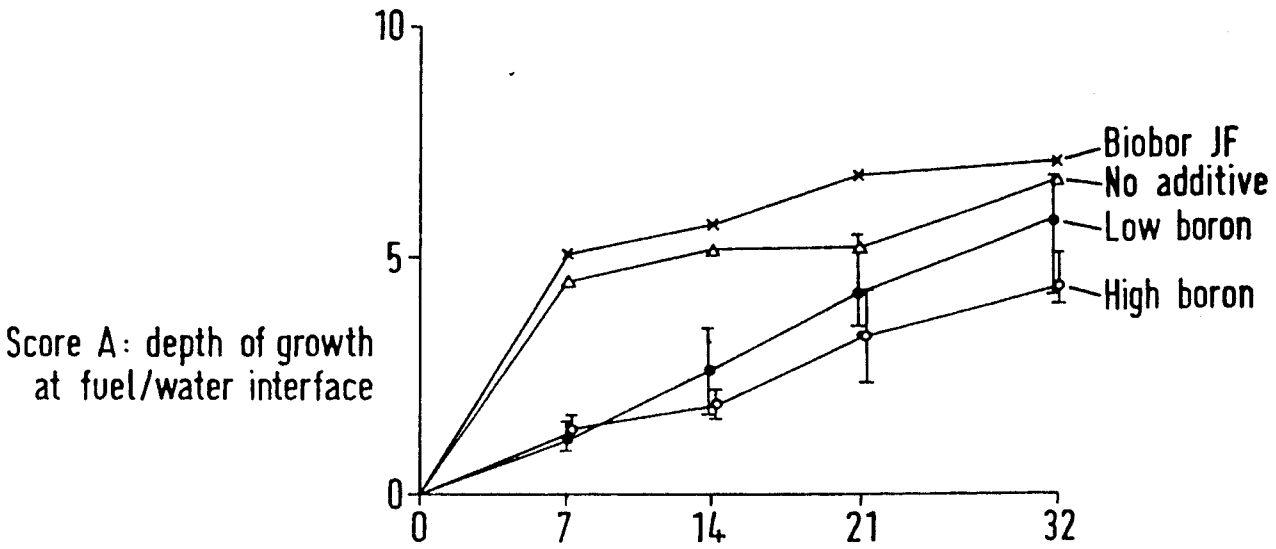
FIG. 1A depicts Score A as a function of days of incubation for *Aspergillus niger;*

In the majority of the Examples a commercially available polyisobutene mono-succinimide, designated hereinafter as PMS, which is a polyisobutene (molecular weight about 1000) substituted succinic anhydride 1:1 adduct of tetraethylpentamine (TEPA) was employed as the starting material. In one Example a polyisobutene bis-succinimide, designated hereinafter as PBS, which is a polyisobutene (molecular weight about 1000) substituted succinic anhydride 2:1 product of TEPA was employed.

Preparative Methods (I) An aqueous solution of boric acid at a temperature of about 40° C. was added to a mixture of carrier (base oil) and either the PMS or PBS over a period of 30 minutes in a Manton Gaulin mill and homogenised for 2–3 hours, whereupon much of the water evaporated. The resulting liquid was drained from the homogeniser and used without further treatment.

(II) One mole of either the PMS or PBS was heated to 175° C. at atmospheric pressure. Boric acid (2 moles) was slowly added and the mixture reacted for one hour. Vacuum was then applied and held for one hour. The vacuum was then released and the hot mixture decanted and filtered.

TABLE 1

| | (a) | (b) | (c) | (d) |
|---|---|---|---|---|
| Nitrogen (% wt) | 0.72 | 0.78 | 2.68 | 1.8 |
| Boron (% wt) | 1.1 | 1.2 | 0.96 | 0.42 |

The additives (a)–(d) were compounded into a multifunctional diesel fuel additive package which was tested in diesel fuel. In addition to the biostat additive (boronated succinimide (a)–(d)) the package contained an anti-rust agent, an anti-foam agent, a demulsifier and an antioxidant.

In the following tests A–H the boronated succinimides and boron fuel levels are as shown in Table 2.

TABLE 2

| Ashless Additive | Test Fuels | Preparative Method | Boronated Material | Boron Fuel Level (ppm wt) |
|---|---|---|---|---|
| (a) | A | I | PMS | 0.31 |
| | B | | PMS | 3.08 |
| (b) | C | I | PMS | 0.33 |
| | D | | PMS | 3.33 |
| (c) | E | II | PBS | 0.16 |
| | F | | PBS | 1.66 |
| (d) | G | II | PMS | 0.12 |
| | H | | PMS | 1.18 |

Additive Testing

The test fuels A–H were tested with 4 fungal strains using a method described by Smith and Crook. [The germination and growth of *Cladosporium resinae* in fuel oil. 'Biodeterioration. The Proceedings of the Fourth International Biodeterioration Symposium, Berlin' (T. A. Oxley, G. Becker and D. Allsopp, eds) Pitman, London, pp 29–36, 1980]. In this method sterile aqueous medium in test tubes is innoculated with a suspension of fungal spores and then overlaid with fuel containing known levels of test additives. Tubes are incubated for ca. 28 days and examined periodically for development of the fungi at the fuel/water interface.

In addition a test fuel (I) containing no additive was tested. Finally, a commercially available additive (Biobor JF, ex US borax) was tested in test fuels X and Y (270 ppm level).

Microbiological Methods (a) Mould cultures

Four cultures were employed as follows:

*Aspergillus niger,*
Cephalosporium sp,
Cladosporium sp, and
*Penicillium avellaneum.*

(b) Preparation of conidial suspension

Mould cultures were grown initially on Sabouraud Dextrose Agar slopes (5 slopes of each strain) for 10 days at 27° C. Sterile quarter strength Ringers solution (5 ml) was added to each slope and shaken to obtain a conidial (spore) suspension. The suspensions were then spun in a Sorvall Superspeed centrifuge type SS3 at 5000 rpm for 15 minutes. The conidial pellet was washed once with sterile quarter strength Ringers solution and the suspension adjusted to give a final concentration of $10^6$ conidia per ml.

(c) Screening in test-tube culture

Mains tap water, enriched with 10% Bushnell and Haas medium [a mineral salts medium for the culture of hydrocarbon utilising fungi consisting of $NH_4NO_3$ (1 g), $KH_2PO_4$ (1 g ), $K_2HPO_4$ (1 g), $MgSO_4$ (0.2 g), $FeCl_3$ (0.01 g), $CaCl_2$ (0.02 g), distilled water (1 liter), pH 7.0±0.3, autoclaved at 121° C. for 15 minutes (Bushnell, L. D. and Haas, H. F., J. Bact, 41, 653–673, 1941)] and 0.5% (wt) of yeast extract was dispensed in 2.5 ml aliquots in 20 ml Bellco screw capped glass test-tubes and then sterilised by autoclaving at 121° C. for 15 minutes. A series of tubes was then inoculated with 1 drop of conidial suspension using a sterile Pasteur pipette. A 2.5 ml aliquot of test fuel was then overlaid on the aqueous medium. Uninoculated aqueous medium overlaid with test fuel was used as control. Five replicates were used for each fuel sample. The procedure was repeated for all four test species.

The control fuels, i.e. diesel fuel minus additives and diesel fuel containing the jet fuel biocide, Biobor JF (Borax Holdings Limited) at a concentration of 270 ppm (20 ppm boron), were laid over inoculated and uninoculated medium as above.

All tubes were then incubated at 25° C. for 32 days. Tubes were examined after 7, 14, 21 and 32 days. The extent of growth at the fuel/water interface and in the aqueous phase was recorded.

Scoring of Results

The depth of interface contamination was measured roughly and expressed numerically as SCORE A. The degree of fungal colony development in the water was estimated as nil (0), feeble (+), good (++) or very good (+++) and this was converted to a numerical score, viz 0, 1, 2 or 3 (SCORE B).

Results

Figure 1B:
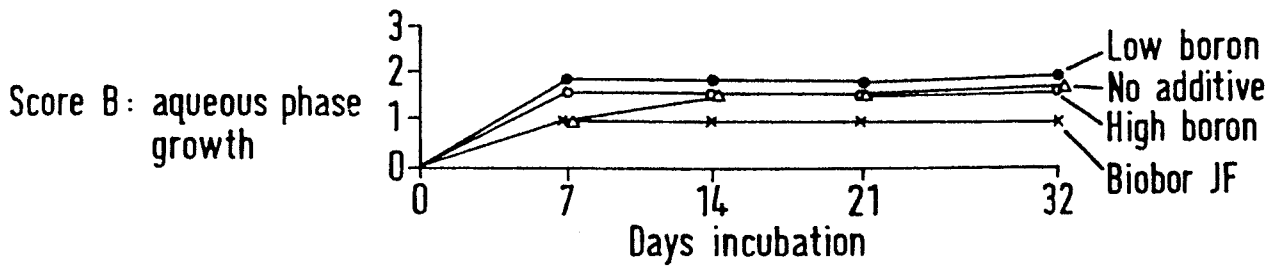
FIG. 1B depicts Score B as a function of days of incubation for *Aspergillus niger;*
Figure 2A:
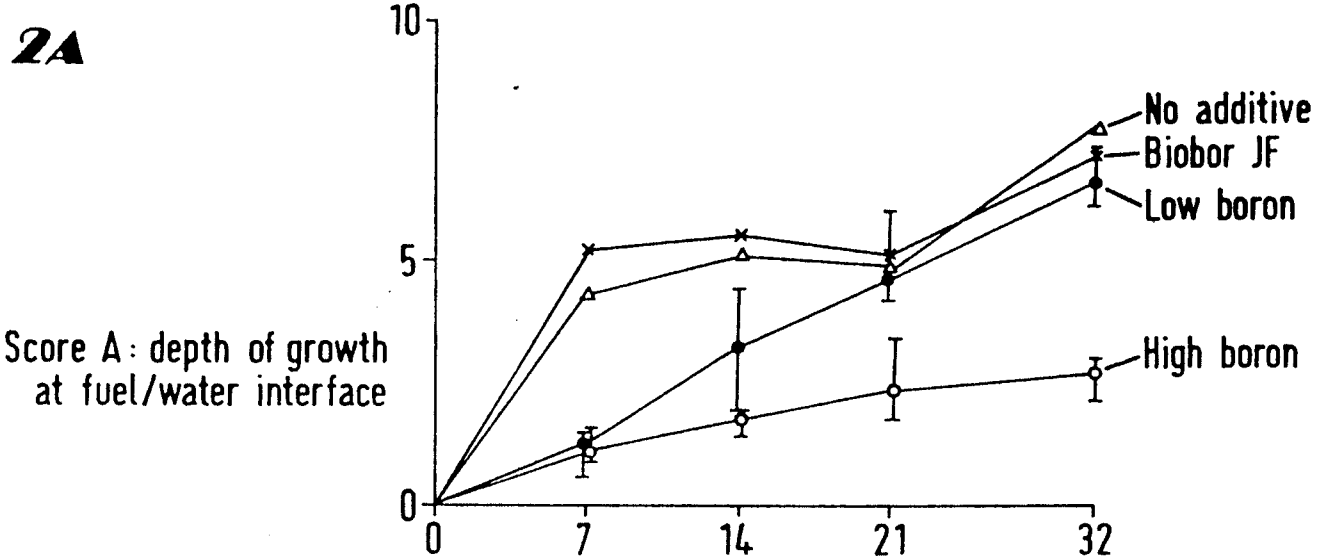
FIG. 2A depicts Score A as a function of days of incubation for Cephalosporium.
Figure 2B:
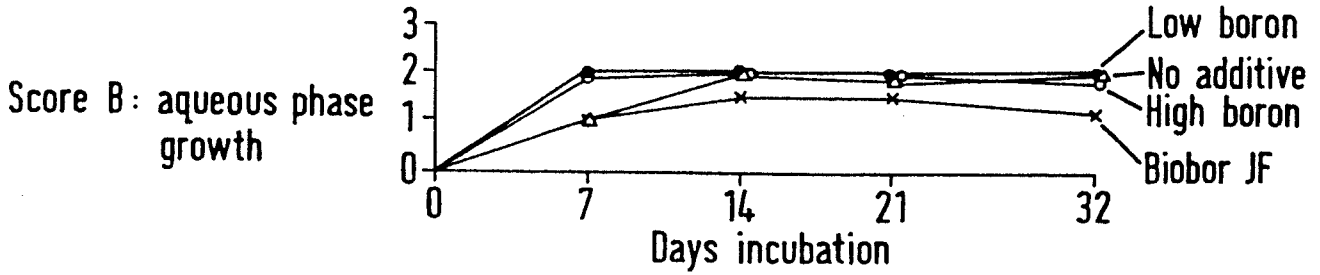
FIG. 2B depicts Score B as a function of days of incubation for Cephalosporium.
Figure 3A:
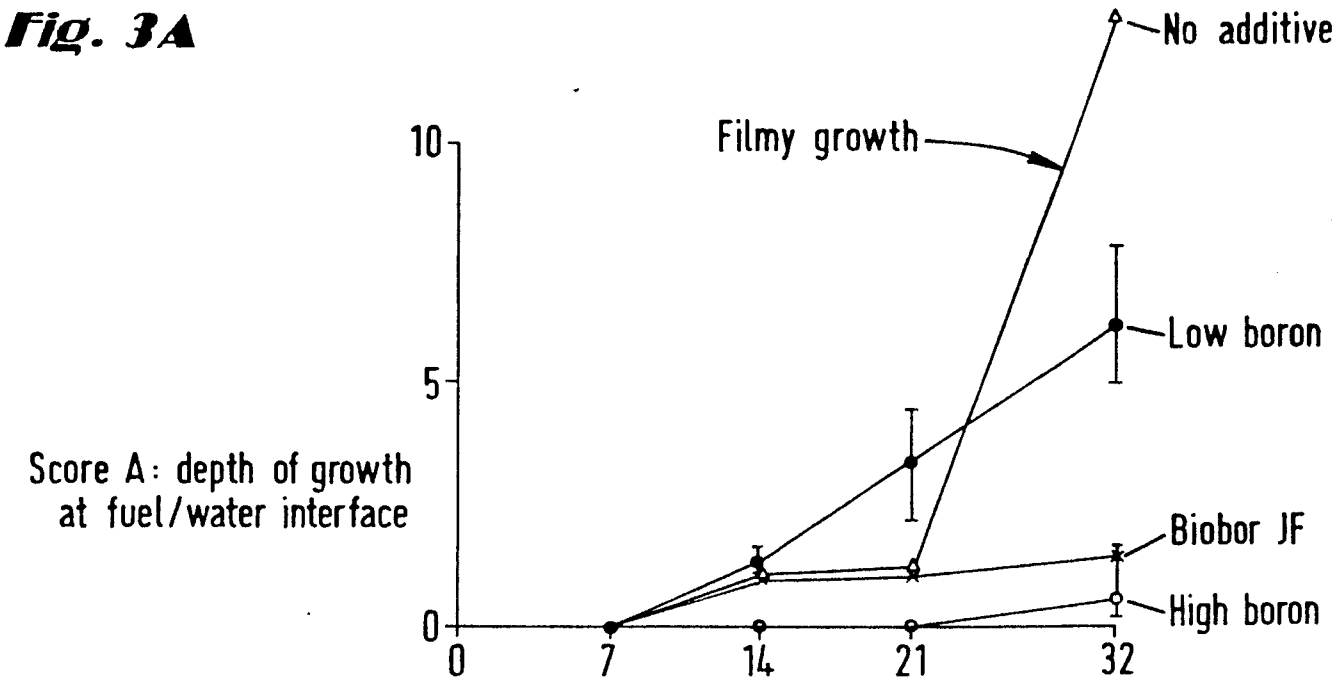
FIG. 3A depicts Score A as a function of days of incubation for Cladosporium.
Figure 3B:
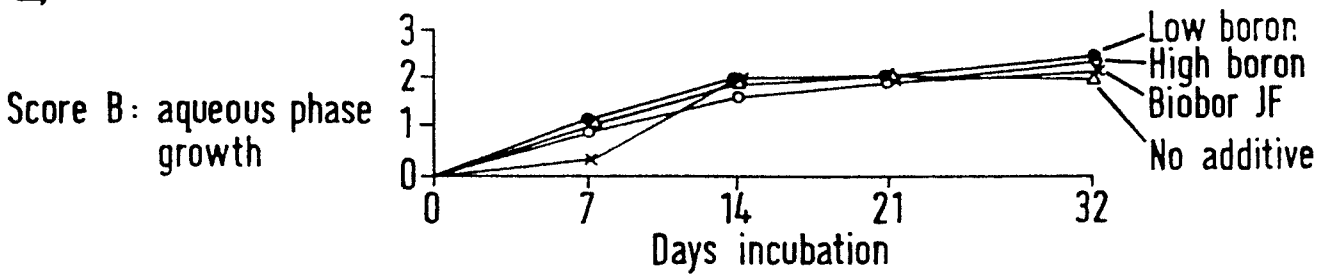
FIG. 3B depicts Score B as a function of days of incubation for Cladosporium.
Figure 4A:
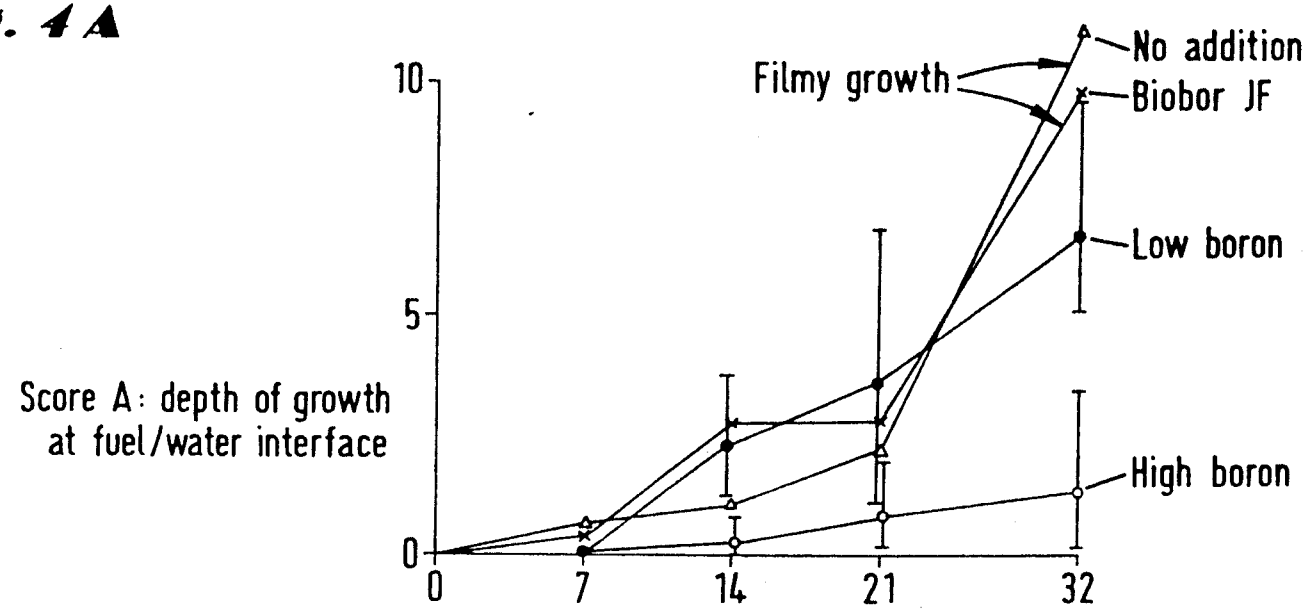
FIG. 4A depicts Score A as a function of days of incubation for *Penicillium avellaneum.
Figure 4B:
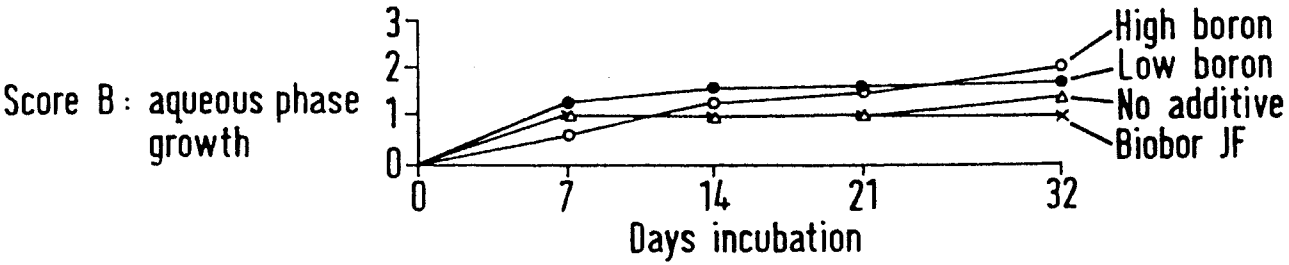
* and FIG. 4B depicts Score B as a function of days of incubation for *Penicillium avellaneum.*

The averaged scores for the five replicates of each treatment are given in Table 3. The scores for the low boron levels and the higher boron levels for each funal strain were then combined and are depicted in FIGS. 1 to 4 with the matching results for fuel containing Biobor JF and untreated fuel. Error bars indicate the spread of results for the low and higher boron additive levels.

For inhibition of fungal development at the fuel/water interface (SCORE A results) there seemed to be little differentation between the four sets of additives, i.e. A/B, C/D, E/F and G/H. The low boron additive levels showed indications of early hold-back of interface development with Aspergillus and Cephalosporium. The higher boron level did check fungal growth at the interface up to 21 days for Cladosporium and was effective until after 14 days with Penicillium. At the end of the 32 day test period, the fuels containing higher boron additive levels were much less heavily contaminated at the interface than the other fuels.

Biobor JF was ineffective in protecting the interface except in the case of Cladosporium.

In the aqueous phase, Biobor JF was slightly more inhibitory to fungal development but, on the whole, none of the additives were particularly effective (SCORE B results).

TABLE 3

| | | | Test Results | | | | | | | |
|---|---|---|---|---|---|---|---|---|---|---|
| | | | Interface contamination estimated in mms (Score A) (days) | | | | Aqueous phase contamination estimate (Score B) (days) | | | |
| Strain | Fuel | Boron (ppm) | 7 | 14 | 21 | 32 | 7 | 14 | 21 | 32 |
| *Aspergillus niger* | A | 0.31 | 1.3 | 2.1 | 5.5 | 6.9 | 2.0 | 2.0 | 2.0 | 2.0 |
| | C | 0.33 | 1.0 | 1.8 | 3.9 | 6.0 | 1.6 | 1.6 | 1.4 | 2.0 |
| | E | 0.16 | 1.3 | 3.2 | 4.2 | 4.4 | 2.0 | 2.0 | 2.0 | 2.0 |
| | G | 0.12 | 1.1 | 3.5 | 3.6 | 6.4 | 2.0 | 2.0 | 2.0 | 2.0 |
| | means | | 1.18 | 2.65 | 4.30 | 5.93 | 1.90 | 1.90 | 1.85 | 2.00 |
| | B | 3.08 | 1.3 | 1.8 | 4.4 | 5.2 | 2.0 | 2.0 | 2.0 | 2.0 |
| | D | 3.33 | 1.1 | 1.8 | 3.8 | 4.4 | 1.6 | 1.0 | 1.0 | 1.2 |
| | F | 1.66 | 1.6 | 1.7 | 3.1 | 4.2 | 1.4 | 1.4 | 1.4 | 1.6 |
| | H | 1.18 | 1.3 | 2.2 | 2.4 | 4.2 | 1.8 | 1.8 | 1.8 | 2.0 |
| | means | | 1.33 | 1.88 | 3.43 | 4.50 | 1.70 | 1.55 | 1.55 | 1.70 |
| | + Biobor JF | 20.00 | 5.1 | 5.7 | 6.8 | 7.1 | 1.0 | 1.0 | 1.0 | 1.0 |
| | No additive | | 4.5 | 5.2 | 5.2 | 6.7 | 1.0 | 1.6 | 1.6 | 1.8 |
| Cephalosporium sp. | A | 0.31 | 1.3 | 1.9 | 4.3 | 6.6 | 2.0 | 2.0 | 2.0 | 2.0 |
| | C | 0.33 | 0.6 | 3.9 | 6.0 | 7.2 | 2.0 | 2.0 | 2.0 | 2.0 |
| | E | 0.16 | 1.3 | 2.7 | 4.2 | 6.2 | 2.0 | 2.0 | 2.0 | 2.0 |
| | G | 0.12 | 1.3 | 4.4 | 4.2 | 7.4 | 2.0 | 2.0 | 2.0 | 1.6 |
| | means | | 1.13 | 3.23 | 4.68 | 6.85 | 2.00 | 2.00 | 2.00 | 1.90 |
| | B | 3.08 | 1.0 | 1.4 | 3.4 | 3.0 | 2.0 | 2.0 | 2.0 | 2.0 |
| | D | 3.33 | 1.1 | 1.9 | 1.7 | 2.1 | 1.8 | 1.8 | 1.0 | 1.4 |
| | F | 1.66 | 1.5 | 1.9 | 2.1 | 2.2 | 1.8 | 2.0 | 2.0 | 2.0 |
| | H | 1.18 | 1.0 | 1.9 | 2.2 | 3.0 | 2.0 | 2.0 | 2.0 | 2.0 |
| | means | | 1.15 | 1.78 | 2.35 | 2.58 | 1.90 | 1.95 | 1.75 | 1.85 |
| | + Biobor JF | 20.00 | 5.2 | 5.5 | 5.1 | 7.2 | 1.0 | 1.6 | 1.6 | 1.2 |
| | No additive | | 4.3 | 5.1 | 4.9 | 7.8 | 1.0 | 2.0 | 2.0 | 2.0 |
| Cladosporium sp. | A | 0.31 | 0 | 1.6* | 2.8* | 5.0* | 0 | 0 | 0 | 0 |
| | C | 0.33 | 0 | 1.3* | 3.5 | 6.1 | 1.0 | 2.0 | 2.0 | 2.2 |
| | E | 0.16 | 0 | 1.0 | 4.5' | 7.8 | 1.0 | 2.0 | 2.0 | 2.8 |
| | G | 0.12 | 0 | 1.2 | 2.2 | 5.9 | 1,4 | 2.0 | 2.0 | 2.2 |
| | means | | 0 | 1.28* | 3.25 | 6.20 | 1.10 | 2.00 | 2.00 | 2.45 |
| | B | 3.08 | 0 | 0 | 0 | 0 | 0.8 | 1.8 | 2.0 | 2.0 |
| | D | 3.33 | 0 | 0 | 0 | 0 (1) | 1.0 | 1.0 | 1.8 | 2.0 |
| | F | 1.66 | 0 | 0 | 0 | 0.4 | 1.0 | 2.0 | 2.0 | 2.8 |
| | H | 1.18 | 0 | 0 | 0 | 0 | 1.0 | 2.0 | 2.0 | 2.4 |
| | means | | 0 | 0 | 0 | 0.5 | 0.95 | 1.70 | 1.95 | 2.35 |
| | + Biobor JF | 20.00 | 0 | 1.0 | 1.0 | 1.3 | 0.4 | 2.0 | 2.0 | 2.0 |
| | No additive | | 0 | 1.0 | 1.1 | 12.5' | 1.0 | 2.0 | 2.0 | 2.0 |
| *Penicillium avellanae* | A | 0.31 | 0.2 | 3.0 | 4.4 | 7.0 | 1.4 | 1.6 | 1.6 | 1.6 |
| | C | 0.33 | 0 | 3.8 | 6.9 | 9.7 | 1.0 | 1.0 | 1.0 | 1.4 |
| | E | 0.16 | 0 | 1.0 | 2.2* | 5.2* | 2.0 | 2.0 | 2.0 | 2.0 |
| | G | 0.12 | 0 | 1.4 | 1.1 | 5.3 | 1.6 | 1.8 | 1.8 | 2.0 |
| | means | | 0 | 2.30 | 3.65 | 6.80 | 1.25 | 1.60 | 1.60 | 1.75 |
| | B | 3.08 | 0 | 0 | 0 | 0 (2) | 0.4 | 0.8 | 2.0 | 2.0 |
| | D | 3.33 | 0 | 0 | 0 | 0 (3) | 0.2 | 0.6 | 0.4 | 2.2 |
| | F | 1.66 | 0 | 0 | 0 | 0.3 | 1.0 | 2.0 | 2.0 | 2.0 |
| | H | 1.18 | 0.1 | 0.8 | 1.4 | 2.5 | 0.8 | 1.8 | 1.8 | 2.0 |
| | means | | 0 | 0.24 | 0.85 | 1.38 | 0.60 | 1.30 | 1.55 | 2.05 |
| | + Biobor JF | 20.00 | 0.4 | 2.8 | 2.8 | 9.9' | 1.0 | 1.0 | 1.0 | 1.0 |
| | No additive | | 0.6 | 1.0 | 2.2 | 11.1' | 1.0 | 1.0 | 1.0 | 1.0 |

*growth patchy
' filmy growth
(1) 1 of 5 replicates grew with score 1.0 1.0 1.0 2.5
(2) 1 of 5 replicates grew with score 0 0.1 5.5 7.0
(3) 2 of 5 replicates grew with scroe 0.5 0.5 2.0 3.5

We claim:

1. A process for the prevention of aerobic fungal growth in hydrocarbons selected from diesel fuels, heavy marine fuels and fuel oils, said hydrocarbons being in storage and contaminated with water, said process comprising the step of adding to said hydrocarbons an additive comprising boric acid or a salt thereof and a hydrocarbyl-substituted succinimide in which the hydrocarbyl substituent contains from about 40 to 150 carbon atoms, said additive being used in an amount sufficient to provide up to 500 ppm wt in the hydrocarbons.

2. A process according to claim 1, wherein the boric acid or salt thereof is present in the additive in the form of a physical admixture with the hydrocarbyl-substituted succinimide.

3. A process according to claim 1, wherein the boric acid or salt thereof is present in the additive chemically bound to the hydrocarbyl-substituted succinimide.

4. A process according to claim 1, wherein the boric acid or salt thereof is present in the form of a particulate dispersion of the boric acid or salt thereof.

5. A process according to claim 4, wherein the boric acid or salt thereof is the ammonium salt of boric acid.

6. A process according to claim 4, wherein the particulate dispersion incorporates a carrier for the boric acid or a salt thereof, which carrier is a hydrocarbon-compatible high-boiling material.

7. A process for the prevention of aerobic fungal growth in hydrocarbons selected from diesel fuels, heavy marine fuels and fuel oils, said hydrocarbons being in storage and contaminated with water, said process comprising the step of adding to said hydrocarbons an additive comprising boric acid and a hydrocarbyl-substituted succinimide in which the hydrocarbyl substituent contains from about 40 to 150 carbon atoms, said additive being used in an amount sufficient to provide up to 500 ppm wt in the hydrocarbons.

8. A process according to claim 1, wherein the amount of additive used is sufficient to provide up to 200 ppm weight in the hydrocarbon.

9. A fuel composition comprising hydrocarbon selected from diesel fuels, heavy marine fuels and fuel oils, said hydrocarbons being in storage and contaminated with water and an additive for inhibiting fungal growth comprising boric acid or a salt thereof and a hydrocarbyl-substituted succinimide in which the hydrocarbyl substituent contains from about 40 to 150 carbon atoms, said additive being present in an amount sufficient to provide up to 500 ppm wt in the hydrocarbon.

10. A fuel composition comprising hydrocarbon selected from diesel fuels, heavy marine fuels and fuel oils, said hydrocarbons being in storage and contaminated with water and an additive for inhibiting fungal growth comprising boric acid and a hydrocarbyl-substituted succinimide in which the hydrocarbyl substituent contains from about 40 to 150 carbon atoms, said additive being present in an amount sufficient to provide up to 500 ppm wt in the hydrocarbon.

11. A process according to claim 1, wherein the hydrocarbyl substituent of the succinimide is a polyisobutene containing from about 40 to about 150 carbon atoms.

* * * * *